US005737981A

United States Patent [19]

Hildebrand

[11] Patent Number: 5,737,981

[45] Date of Patent: Apr. 14, 1998

[54] REMOVAL DEVICE FOR THREADED CONNECTING DEVICES

[76] Inventor: David Lewis Hildebrand, 135 Gay St., Longmont, Colo. 80501

[21] Appl. No.: 825,885

[22] Filed: Apr. 2, 1997

Related U.S. Application Data

[63] Continuation of Ser. No. 531,336, Sep. 20, 1995, abandoned.

[51] Int. Cl.[6] ..... B25B 13/50

[52] U.S. Cl. ..... 81/53.2; 81/120

[58] Field of Search ..... 81/53.2, 120, 121.1, 81/124.6, 186

[56] References Cited

U.S. PATENT DOCUMENTS

| | | | |
|---|---|---|---|
| 1,469,833 | 10/1923 | Hanson | 81/120 X |
| 1,590,200 | 6/1926 | McGuckin | 81/120 |
| 2,521,910 | 9/1950 | Goldberg | 81/53.2 X |
| 3,161,090 | 12/1964 | McLellan | 81/53.2 |
| 3,996,819 | 12/1976 | King | 81/124.6 |
| 4,671,141 | 6/1987 | Hanson | 81/53.2 |
| 5,551,320 | 9/1996 | Horobec et al. | 81/53.2 |

*Primary Examiner*—James G. Smith
*Attorney, Agent, or Firm*—Rick Martin

[57] ABSTRACT

A removal device adapted for the removal of difficult to remove threaded connecting devices threaded in a first direction. The device includes a body having a first end and a second end, wherein the first end includes an opening which extends toward the second end of the body. The opening is sized to receive a threaded connecting device threaded in a first direction and continuously tapers from a first diameter at the first end to a second diameter as it extends toward the second end, wherein the first diameter is larger than the second diameter. The opening further includes an internal surface threaded in direction opposite the threading of the threaded connecting device which must be removed. The device further includes structure for rotating the body when it is positioned over the threaded connecting device, wherein rotation of the body causes the internal threading of the removal device to engage the threaded connecting device causing the threaded connecting device to rotate in a direction appropriate for the removal of the threaded connecting device threaded in the first direction.

14 Claims, 1 Drawing Sheet

REMOVAL DEVICE FOR THREADED CONNECTING DEVICES

CROSS-REFERENCED PATENTS

This is a Continuing application from U.S. patent application Ser. No. 08/531,336, filed Sep. 20, 1995, now abandoned.

BACKGROUND OF THE INVENTION

1. Field of the Invention

The invention relates to a device for the removal of threaded connecting devices. More particularly, the invention relates to an internally threaded removal device for the removal of threaded connecting devices, wherein the removal device is threaded in a direction opposite to the threading direction of the threaded connecting device.

2. Background of the Invention

Everyone is confronted at sometime with a nut that for some reason cannot be removed from the object to which it is secured, although the nut must be removed before the individual can continue with the project he or she is undertaking.

In most instances the individual must use tools not designed for the purpose of removing the nut. This often results in further damage to the object to which the nut is secured. For example, when the nut includes a hexagonal or square shaped head designed for a specific size socket which has been worn over time by use or abuse, the socket no longer properly fits over the head. As a result, the nut is not able to be removed in the appropriate manner. The individual must then somehow rotate the nut. This is often attempted with a wrench vice grips, or other tool, not designed for the job.

Attempts have been made to overcome this problem by providing tools which will engage and rotate the nut. However, these attempt have met with only limited success. For example, U.S. Pat. No. 3,161,090 to McLellan discloses a stud engaging wrench having a fluted gripping surface. The wrench is provide with a plurality of flutes designed to engage the threads of a stud. The helix of the flutes is designed to cooperate with the direction of the threads of the stud so as to be opposite thereto. The flutes directly engage the threads permitting removal of the stud when the wrench is rotated. The use of flutes as disclosed by McLellan is, however, limited in effectiveness due to the nature of the flutes themselves. Specifically, the flutes disclosed by McLellan are very much like the grooves in a drill bit. As such, the flutes are designed to engage textured surfaces, for example, the threaded outer surface of a stud, in much the same way a drill bit is most effective in boring through textured materials. Similarly, U.S. Pat. No. 3,996,819 to King discloses a socket wrench attachment for the removal of a screw or nut. The attachment includes a conical opening with a plurality of teeth positioned therein. As stated previously, the prior art devices for the removal of threaded connecting devices are limited in their effectiveness. Consequently, a need continues to exist for a device permitting the simple and effective removal of threaded connecting devices. The present invention provides such a device.

SUMMARY OF THE INVENTION

It is, therefore, an object of the present invention to provide a removal device adapted for the removal of threaded connecting devices that are threaded in a first direction. The removal device includes a body having a first end and a second end, wherein the first end includes an opening extending toward the second end of the body. The opening is sized to receive a threaded connecting device threaded in a first direction, and the opening continuously tapers from a first diameter at the first end to a second diameter as the opening extends toward the second end, wherein the first diameter is larger than the second diameter. The opening is defined by an internal surface threaded in a direction opposite the threading of the threaded connecting device. The removal device further includes structure for rotating the body when it is positioned over the threaded connecting device, wherein rotation of the body causes the internal threading of the removal device to engage the threaded connecting device to cause the threaded connecting device to rotate in a direction appropriate for the removal of the threaded connecting device.

It is another object of the present invention to provide a removal device including at least one cutting notch on the internal surface, wherein the at least one cutting notch is substantially perpendicular to the threading on the internal surface defining the opening.

It is also an object of the present invention to provide a removal device wherein the structure for rotating includes a projection on the second end, the projection being sized and shaped for use with a socket.

It is also another object of the present invention to provide a removal device wherein the body is hollow as it extends from the first end to the second end.

It is another object of the present invention to provide a removal device wherein the opening is frustoconically shape.

Other objects, advantages and salient features of the invention will become apparent from the following detailed description, which taken in conjunction with the annexed drawings, discloses a preferred, but non-limiting, embodiment of the subject invention.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 3:
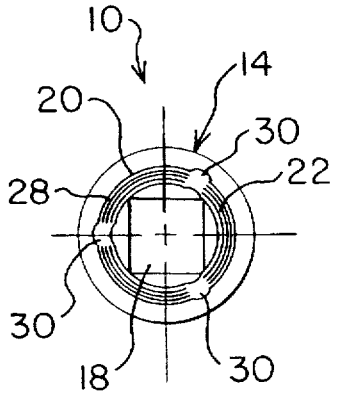
FIG. 3 is a bottom view of the removal device.
Figure 1:
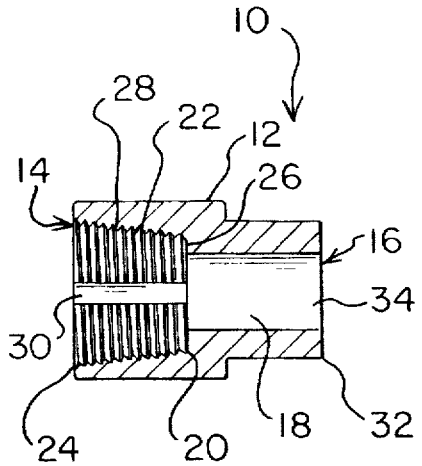
FIG. 1 is a cross-sectional view of the removal device.
Figure 2:
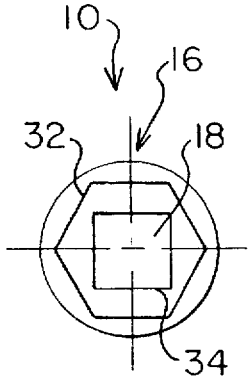
FIG. 2 is a top view of the removal device.

With reference to FIGS. 1–3, a removal device 10 adapted for the removal of threaded connecting devices is disclosed. For the purposes of the present application, use of the term "threaded connecting device(s)" should be understood to refer to devices having a portion which must be rotated to facilitate attachment of the connecting device to an object. For example, the present removal device may be used with convention bolt and nut arrangements where internal threading on the nut engages external threading on the bolt. Alternately, the present removal device may be used with a threaded bolt having a head intended to be engaged by a socket, wrench, or other tool, to place the bolt within an internally threaded hole. Similarly, the present removal device could be used with a simple externally threaded stud positioned within an internally threaded hole. These examples should not be considered as limiting applications for the present removal device, but merely as exemplary of the many uses of the present device.

The removal device 10 includes a cylindrical body 12 having a first end 14 and a second end 16. The body 12 is hollow as it extends from the first end 14 to the second end 16 to permit studs and bolts to pass through the body 12 as the removal device 10 is used. The hollow center 18 also provides room for boring and threading tools used during the manufacture of the removal device 10.

The first end 14 includes a frustoconical opening 20 which extends toward the second end 16 of the body 12. The frustoconical opening 20 is defined by an internal surface 22 of the body 12 adjacent the first end 14 of the body 12. In the preferred embodiment, the opening 20 extends only a portion of the distance between the first end 14 and the second end 16 of the body 12. In fact, the opening 20 in the preferred embodiment extends only about one third of the distance between the first end 14 and the second end 16 of the body 12.

The opening 20 is sized to receive a threaded connecting device threaded in a first direction. The opening 20 continuously tapers from a first diameter 24 at the first end 14 to a second diameter 26 as it extends toward the second end 16, wherein the first diameter 24 is larger than the second diameter 26. The internal surface 22 of the body 12 defining the opening 20 has threads 28 formed in a second direction opposite to the first direction in which the threaded connecting device is threaded. That is, if the threaded connecting device has a right hand thread (regular thread), then the internal surface 22 of the body 12 will be threaded with a left hand thread (reverse thread). Similarly, if the threaded connecting device has a left hand thread (reverse thread), then the internal surface 22 of the body 12 will be threaded with a right hand thread (regular thread). It should be understood that while the threading 28 on the internal surface 22 must be in a direction opposite the threading direction of the threaded connecting device, the threading and taper may vary in accordance with the application of the removal device without departing from the spirit of the present invention.

The internal surface 22 defining the opening 20 may also be provided with cutting notches 30 extending along the internal surface 22 in a direction approximately perpendicular to the threading 28. While three cutting notches 30 are shown in FIG. 3, the removal device 10 may include as many cutting notches as desired depending upon the application of the removal device, without departing from the spirit of the present invention. Additional cutting notches may be possible where the application of the removal device permits. The cutting notches 30 help the threads to cut into the threaded connecting device to permit removal of the threaded connecting device in a manner that will be discussed below.

Figure 4:
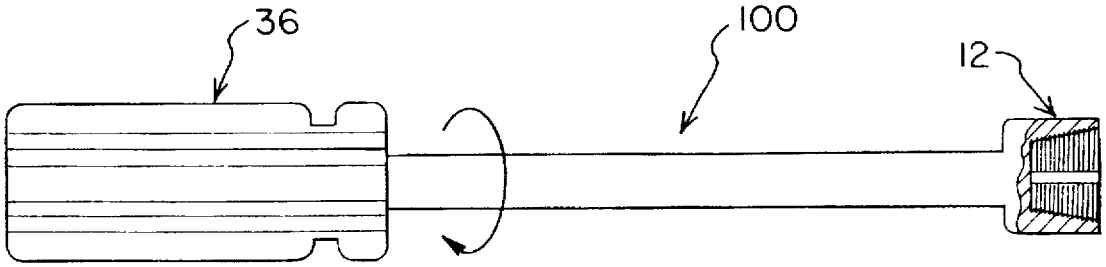
FIG. 4 is an alternate embodiment of the removal device with a handle secured thereto.
Figure 5:
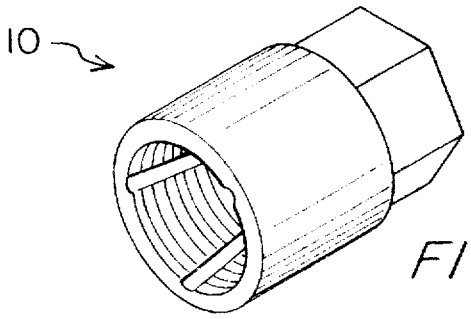
FIG. 5 is an isometric view of the removal device.

A projection 32 is secured to the second end 16 of the body 12. The projection 32 is sized and shaped for use with a socket permitting the removal device 10 to be rotated when it is placed over the threaded connecting device. As shown in FIG. 2, the projection 32 may be hexagonal shaped for use with hexagonal shaped sockets. Additionally, the second end 16 includes a square opening 34 designed for engagement with conventional square connecting elements used in socket wrenches, and other tools, where different attachments may be releasably secured to the wrench. While, the preferred embodiment is disclosed with a hexagonal shaped projection 32, a variety of projection shapes and sizes could be used without departing from the spirit of the present invention. Similarly, the second end 16 of the body 12 could be provided with a handle 36 facilitating rotation, without departing from the spirit of the present invention (See FIG. 4 removal device 100).

In use, the removal tool is place over a threaded connecting device with the frustoconical opening over the threaded connecting device. For example, the removal tool could be place over a worn nut secured to a bolt. The removal tool is then rotated in a direction causing the threading on the internal surface to engage the threaded connecting device by cutting into the outer surface thereof. Once the threaded connecting device is properly engaged, continued rotation of the removal device causes rotation of the threaded connecting device and ultimately removal of the threaded connecting device from the object to which it was attached. Removal of the threaded connecting device in this manner is achieved as a result of the fact that the internal surface of the body is threaded in a direction opposite to that of the threaded connecting device.

It should be understood that the body of the present removal device can be manufacture from a variety of metals depending upon the application for which the device is intended. The body could also be manufactured from plastic, or other materials, where the application of the removal device permits. In addition, the removal device can be made in a variety of shapes and sizes depending upon the use of the device.

While various preferred embodiments have been shown and described, it will be understood that there is no intent to limit the invention by such disclosure, but rather, is intended to cover all modifications and alternate constructions falling within the spirit and scope of the invention as defined in the appended claims.

I claim:

1. A removal device adapted for the removal of difficult to remove threaded connecting devices, comprising:

a body having a first end and a second end, the first end including an opening which extends toward the second end of the body;

the opening is defined by an internal surface of the body and is sized to receive a threaded connecting device threaded in a first direction, wherein the internal surface is threaded in a second direction opposite the first direction in which the threaded connecting device is threaded; the opening continuously tapers from a first diameter at the first end to a second diameter as the opening extends toward the second end, where, in the first diameter is larger than the second diameter;

said opening extends only a portion of a distance between the first end and the second end of the body;

said second end includes an opening designed for engagement with conventional connecting elements used in a removal tool where different connecting elements may be secured to the removal tool; and wherein rotation of the body causes said threading on the internal surface of the removal device to engage the threaded connecting device causing the threaded connecting device to rotate in a direction appropriate for the removal of the threaded connecting device.

2. The device according to claim 1, wherein the internal surface includes at least one cutting notch.

3. The device according to claim 2, wherein said at least one cutting notch is substantially perpendicular to the threading on the internal surface defining the opening.

4. The device according to claim 2, wherein one to five cutting notches are provided on the internal surface defining the opening.

5. The device according to claim 3, wherein the cutting notches are substantially perpendicular to threading on the internal surface defining the opening.

6. The device according to claim 1, wherein said second end further comprises a projection, the projection sized and shaped for use with the connecting element.

7. the device according to claim 6, wherein the projection is hexagonal shaped.

8. The device according to claim 1, wherein the opening is a square opening in the second end of the body.

9. The device according to claim 1, wherein the body is hollow as it extends from the first end to the second end.

10. The device according to claim 1, wherein the opening has a circular cross-sectional shape.

11. The device according to claim 1, wherein a handle is secured to the second end of the body.

12. A removal device adapted for the removal of difficult to remove threaded connecting devices, comprising:

a cylindrical body having a first end and a second end, the body being hollow as it extends from the first end to the second end;

the first end including a frustoconically shaped opening which extends toward the second end of the body and is defined by an internal surface of the body;

the opening is sized to receive a threaded connecting device threaded in a first direction, and the opening continuously tapers from a first diameter at the first end to a second diameter as the opening extends toward the second end, wherein the first diameter is larger than the second diameter;

the internal surface of the body is threaded in a second direction opposite the first direction in which the threaded connecting device is threaded; and a projection secured to the second end of the body, the projection sized and shaped for use with a socket permitting the removal device to be rotated when it is placed over the threaded connecting device to be removed, wherein rotation of the body causes the threading on the internal surface of the removal device to engage the threaded connecting device causing the threaded connecting device to rotate in a direction appropriate for the removal of the threaded connecting device.

13. A removal device adapted for the removal of difficult to remove threaded connecting devices, comprising:

a body having a first end and a second end, the first end including an opening which extends toward the second end of the body;

the opening is defined by an internal surface of the body and is sized to receive a threaded connecting device threaded in a first direction, wherein the internal surface is threaded in a second direction opposite the first direction in which the threaded connecting device is threaded; the opening continuously tapers from a first diameter at the first end to a second diameter as the opening extends toward the second end, wherein the first diameter is larger than the second diameter; and said second end of the body having a handle affixed thereto so that when the body is positioned over the threaded connecting device, rotation of the body causes said threading on the internal surface of the removal device to engage the threaded connecting device causing the threaded connecting device to rotate in a direction appropriate for the removal of the threaded connecting device.

14. The device according to claim 1, wherein the removal tool is a wrench.

* * * * *